United States Patent [19]

Branovich et al.

[11] Patent Number: 4,735,591

[45] Date of Patent: Apr. 5, 1988

[54] METHOD OF MAKING A LONG LIFE HIGH CURRENT DENSITY CATHODE FROM TUNGSTEN AND IRIDIUM POWDERS USING A BARIUM IRIDIATE AS THE IMPREGNANT

[75] Inventors: Louis E. Branovich, Howell Township, Monmouth County; Gerard L. Freeman, Freehold Township, Monmouth County; Bernard Smith, Ocean, all of N.J.

[73] Assignee: The United States of America as represented by the Secretary of the Army, Washington, D.C.

[21] Appl. No.: 46,343

[22] Filed: Apr. 15, 1987

[51] Int. Cl.[4] ..... H01J 9/04

[52] U.S. Cl. ..... 445/50; 445/51; 313/346 DC

[58] Field of Search ..... 445/50, 51; 313/346 R, 313/346 DC

[56] References Cited

U.S. PATENT DOCUMENTS

| | | | |
|---|---|---|---|
| 4,078,900 | 3/1978 | Smith et al. | 445/51 |
| 4,165,473 | 8/1979 | Falce | 313/346 DC X |
| 4,236,287 | 12/1980 | Smith | 445/51 |
| 4,444,718 | 4/1984 | Smith | 445/51 X |
| 4,570,099 | 2/1986 | Green | 313/346 DC X |

*Primary Examiner*—Kenneth J. Ramsey

*Attorney, Agent, or Firm*—Sheldon Kanars; Roy E. Gordon

[57] ABSTRACT

A long life high current density cathode is made from a mixture of tungsten and iridium powders using a barium iridiate as the impregnant by processing the mixture of powders with an activator into a porous billet, and then impregnating the billet with a barium iridiate by firing the billet in a dry hydrogen furnace at a temperature at which the impregnant melts.

7 Claims, No Drawings

METHOD OF MAKING A LONG LIFE HIGH CURRENT DENSITY CATHODE FROM TUNGSTEN AND IRIDIUM POWDERS USING A BARIUM IRIDIATE AS THE IMPREGNANT

The invention described herein may be manufactured, used and licensed by or for the Government for governmental purposes without the payment to us of any royalty thereon.

This invention relates in general to a method of making a long life high current density cathode and in particular, to a method of making such a cathode from a mixture of tungsten and iridium powders using a barium iridiate as the impregnant.

BACKGROUND OF THE INVENTION

This application is co-pending with U.S. patent application Ser. No. 023,161, filed Mar. 6, 1987 for "Method of Making a Long Lived High Current Density Cathode From Tungsten and Iridium Powders" by L. E. Branovich, G. L. Freeman and B. Smith, and now U.S. Pat. No. 4,708,681, assigned to a common assignee. In that application, there is disclosed and claimed a method of making a long lived high current density cathode suitable for operation in microwave devices in which a mixture of tungsten and iridium powders is processed with an activator into a porous billet and the porous billet then impregnated with a chemical mixture of barium oxide, strontium oxide, and aluminum oxide by impregnating the billet in a dry hydrogen furnace at a temperature at which the impregnant melts. This provides the barium atoms that are needed for the generation of electrons.

Though the Ser. No. 023,161 method increases the electron emission of the cathode to a degree, it would be desirable to increase the life and current density of the cathode to an even greater degree.

SUMMARY OF THE INVENTION

The general object of this invention is to provide a method of increasing the life and current density of the cathode of Ser. No. 023,161. A more particular object of the invention is to provide a method of making a long life high current density cathode for millimeter and microwave applications.

It has now been found that the aforementioned objects can be attained by impregnating a tungsten-iridium billet with a barium iridiate.

More particularly, according to the invention, a long life high current density cathode suitable for operation in millimeter and microwave applications is made from a mixture of tungsten and iridium powders using a barium iridiate as the impregnant by a method including the steps of:

(A) mixing the tungsten and iridium powders in the weight ratio of about 65 weight percent tungsten to about 34 weight percent iridium, (B) adding about 1 percent by weight of zirconium hydride to the mixture, (C) ball milling the mixture for about 8 hours, (D) pressing the ball milled mixture into a billet at about 48,000 p.s.i. in a die, (E) sintering the billet at about 1800° C. for about ½ hour in dry hydrogen of less than −100 dewpoint, (F) back filling the billet with copper in dry hydrogen at about 1150° C., (G) machining the billet to the desired geometry, (H) removing the copper by etching in nitric acid, (I) thoroughly rinsing in deionized water, methanol and then drying, (J) firing the billet in dry hydrogen at about 1400° C. for about 15 minutes, (K) impregnating the billet with the barium iridiate, $Ba_3Ir_2O_6$ by firing the billet in a dry hydrogen furnace at about 1550° C. for about two minutes, (L) removing the billet from the furnace after the furnace is cooled, and (M) removing any loose pieces of impregnant from the billet.

DESCRIPTION OF THE PREFERRED EMBODIMENT

A long life high current density cathode is made in the following manner. Tungsten and iridium powders are mixed in a weight ratio of about 65 weight percent tungsten to about 34 weight percent iridium. 1 percent by weight of zirconium hydride activator is added to the mixture and the mixture ball milled for about 8 hours. The ball milled mixture is then pressed into a billet at about 48,000 p.s.i. in a die and the billet then sintered at 1800° C. for ½ hour in dry hydrogen of less than −100 dewpoint. The billet is then backfilled with copper in dry hydrogen at 1500° C., the billet machined to the desired geometry, and the copper then removed by etching in nitric acid. The porous billet is then thoroughly rinsed in deionized water, methanol and then dried. The billet is then hydrogen fired at about 1400° C. for about 15 minutes. The billet is then impregnated with the barium iridiate, $Ba_3Ir_2O_6$ by firing the billet in a hydrogen furnace at about 1550° C. for about two minutes. The billet is removed from the furnace after the furnace is cooled and loose particles of impregnant are removed from the billet using a jeweler's lathe and fine alumina cloth.

The resulting cathode is then mounted in a test vehicle and activated using standard matrix cathode activation procedures. The cathode gives a 50 percent increase in operating life over the cathode of Ser. No. 023,161 at an operating temperature of 1050° C.

The improvement of the cathode made by the method of this invention over the cathode made by the method of Ser. No. 023,161 is due to the fact that the barium iridiate impregnant, $Ba_3Ir_2O_6$ is regenerated giving longer life and a cathode of higher current density at the same temperature.

In the foregoing embodiment, the barium iridiate impregnant, $Ba_3Ir_2O_6$ decomposes inside of the W-Ir billet according to reaction:

$$Ba_3Ir_2O_6 \rightarrow BaIr_2O_4 + 2BaO$$

The BaO generated then reacts with the wall of the W-Ir billet to generate free Ba which is necessary for electron emission according to reaction:

$$6BaO + W \rightarrow 3Ba + Ba_3WO_6 \text{ and}$$

$$6BaO + 2Ir \rightarrow 3Ba + Ba_3Ir_2O_6$$

In the latter equation it is noted just the $Ba_3Ir_2O_6$ is regenerated and can reenter into the aforedescribed chemical reactions.

It should be pointed out that the aforedescribed cycle of the regeneration of the $Ba_3Ir_2O_6$ impregnant is interrupted by competing chemical reactions such as sublimation, evaporating and the gradual depletion of the impregnant. If another BaO is added to the $Ba_3Ir_2O_6$, then another barium iridiate will form, $Ba_4Ir_2O_7$ according to the reaction:

$$BaO + Ba_3Ir_2O_6 \rightarrow Ba_4Ir_2O_7$$

Either of the foregoing barium iridiates can be used as the impregnant in the foregoing embodiment.

The cathode operation is similar to other cathode operations. That is, it is heated in vacuum, and a chemical reaction takes place and barium atoms are released which coat the cathode surface.

In the method of the invention, a small amount of an activator as for example, zirconium hydride is included in the billet. The activator enhances the generation of barium atoms at the cathode operating temperature.

We wish it to be understood that we do not desire to be limited to the exact details of construction as described for obvious modifications will occur to a person skilled in the art.

What is claimed is:

1. Method of making a long life high current density cathode suitable for operation in microwave devices from tungsten and iridium powders using a barium iridiate as the impregnant, said method including the steps of:

(A) mixing the tungsten and iridium powders,
(B) adding about 2 percent by weight of an activator to the mixture,
(C) ball milling the mixture for about 8 hours,
(D) pressing the ball milled mixture into a billet at about 48,000 p.s.i. in a die,
(E) sintering the billet at about 1800° C. for about ½ hour in dry hydrogen of less then −100 dewpoint,
(F) back filling the billet with copper in dry hydrogen at about 1500° C.,
(G) machining the billet to the desired geometry,
(H) removing the copper by etching in nitric acid,
(I) thoroughly rinsing in deionized water, methanol and then drying,
(J) firing the billet in dry hydrogen at about 1400° C. for about 15 minutes,
(K) impregnating the billet with barium iridiate by firing the billet in a dry hydrogen furnace at a temperature at which the impregnant melts for about two minutes,
(L) removing the billet from the furnace after the furnace is cooled, and
(M) removing any loose pieces of impregnant from the billet.

2. Method of making a long life high current density cathode according to claim 1 wherein in Step (A), the tungsten and iridium powders are mixed in a weight ratio of about 65 weight percent tungsten to about 34 weight percent iridium.

3. Method of making a long life high current density cathode according to claim 1 wherein in Step (B), the activator is about 1 weight percent zirconium hydride.

4. Method of making a long life high current density cathode according to claim 1 wherein in Step (K), the barium iridiate is selected from the group consisting of $Ba_3Ir_2O_6$ and $Ba_4Ir_2O_7$.

5. Method of making a long life high current density cathode according to claim 1 wherein in Step (K) the barium iridiate is $Ba_3Ir_2O_6$.

6. Method of making a long life high current density cathode according to claim 1 wherein in Step (K), the barium iridiate is $Ba_4Ir_2O_7$.

7. Method of making a long life high current density cathode suitable for operation in microwave devices from tungsten and iridium powders using a barium iridiate as the impregnant, said method including the steps of:

(A) mixing the tungsten and iridium powders in the weight ratio of about 65 weight percent tungsten to about 34 weight percent iridium,
(B) adding about 1 percent by weight of zirconium hydride to the mixture,
(C) ball milling the mixture for about 8 hours,
(D) pressing the ball milled mixture into a billet at about 48,000 p.s.i. in a die,
(E) sintering the billet at about 1800° C. for about ½ hour in dry hydrogen of less than −100 dewpoint,
(F) back filling the billet with copper in dry hydrogen at about 1150° C.,
(G) machining the billet to the desired geometry,
(H) removing the copper by etching in nitric acid,
(I) thoroughly rinsing in deionized water, methanol and then drying,
(J) firing the billet in dry hydrogen at about 1400° C. for about 15 minutes,
(K) impregnating the billet with the barium iridiate, $Ba_3Ir_2O_6$ by firing the billet in a dry hydrogen furnace at about 1550° C. for about two minutes,
(L) removing the billet from the furnace after the furnace is cooled, and
(M) removing any loose pieces of impregnant from the billet.

* * * * *